United States Patent [19]

Page

[11] Patent Number: 4,555,821

[45] Date of Patent: Dec. 3, 1985

[54] SOFA-BUNK BED COMBINATION

[76] Inventor: Elwin H. Page, 2810 E. 26th St., Brooklyn, N.Y. 11235

[21] Appl. No.: 605,598

[22] Filed: Apr. 30, 1984

[51] Int. Cl.[4] ..... A47C 17/32; A47C 17/37

[52] U.S. Cl. ..... 5/9 R; 5/12 R; 5/58

[58] Field of Search ..... 5/8, 9 R, 9 B, 12 R, 5/58, 411

[56] References Cited

U.S. PATENT DOCUMENTS

| | | | |
|---|---|---|---|
| 2,297,602 | 9/1942 | Woller | 5/9 R |
| 2,528,307 | 10/1950 | Heaney | 5/9 R |
| 2,644,169 | 7/1953 | Read et al. | 5/9 R |
| 2,647,267 | 4/1953 | McLaughlin | 5/9 R |
| 2,691,175 | 10/1954 | Brahm et al. | 5/58 |
| 2,708,755 | 5/1955 | Wilkinson | 5/8 |
| 2,835,901 | 5/1958 | Mills | 5/9 R |
| 2,854,672 | 10/1958 | Hagstrom | 5/9 R |
| 2,937,383 | 5/1960 | Rehfeld | 5/58 |
| 3,070,813 | 1/1963 | Nyman | 5/9 R |
| 3,191,194 | 6/1965 | Griffin | 5/9 R |
| 3,246,347 | 4/1966 | Mason | 5/9 R |
| 3,310,815 | 3/1967 | Griffin | 5/9 R |
| 3,311,932 | 4/1967 | Ahola | 5/9 R |
| 3,316,564 | 5/1967 | Rogers | 5/9 R |
| 3,594,832 | 7/1971 | Bryks | 5/9 R |
| 3,736,601 | 6/1973 | Riches | 5/9 R |
| 3,747,134 | 7/1973 | Montiague | 5/12 R |
| 3,858,254 | 1/1975 | Coomes | 5/8 |
| 3,929,375 | 12/1975 | Gans | 297/440 |
| 3,972,080 | 8/1976 | Shellow et al. | 5/12 R |
| 4,044,410 | 8/1977 | Klinger | 5/9 R |

FOREIGN PATENT DOCUMENTS

| | | | |
|---|---|---|---|
| 248019 | 11/1963 | Australia | 5/8 |
| 83420 | 4/1957 | Denmark | 5/9 R |
| 1028036 | 5/1966 | United Kingdom | 5/9 R |

*Primary Examiner*—Alexander Grosz

*Attorney, Agent, or Firm*—Ostrolenk, Faber, Gerb & Soffen

[57] ABSTRACT

A sofa-bunk bed combination with the lower bunk-sofa seat surrounded by side panels. Upstanding, lateral side elements are located toward the rear at the lateral sides of the lower bunk. There is a back board at the top of the upright side elements of the lower bunk. An upper bunk-sofa back is hingedly connected to the back board. Foldable legs are hingedly connected to the underside of the upper support at the front thereof and are folded down to extend to the lower bunk for supporting the upper bunk. A storage bin at the upright elements at the rear extends forwardly and is hidden behind the downwardly suspended sofa back.

11 Claims, 4 Drawing Figures

FIG. 1
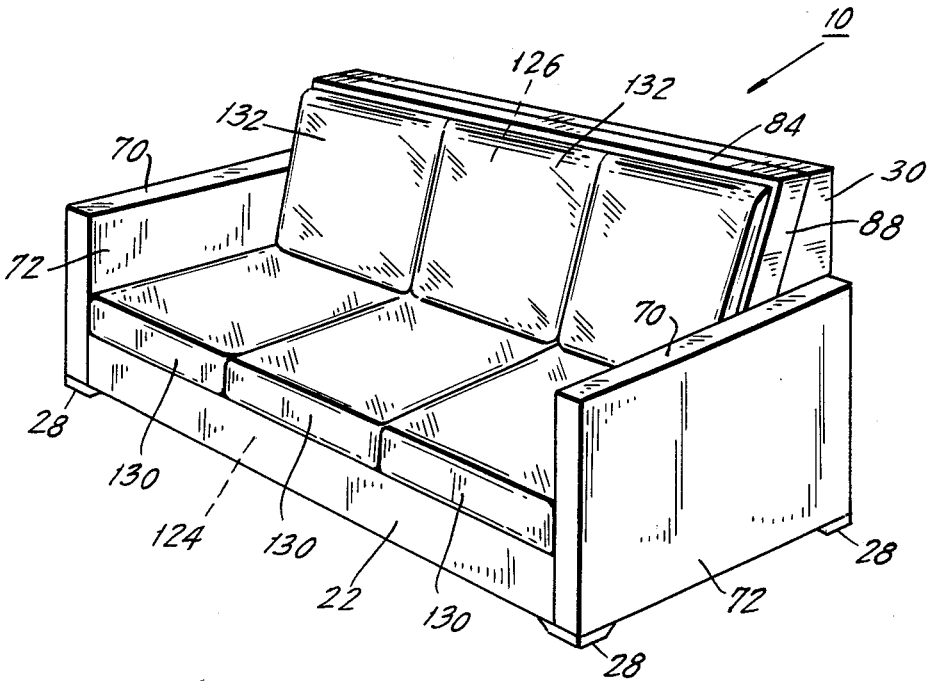
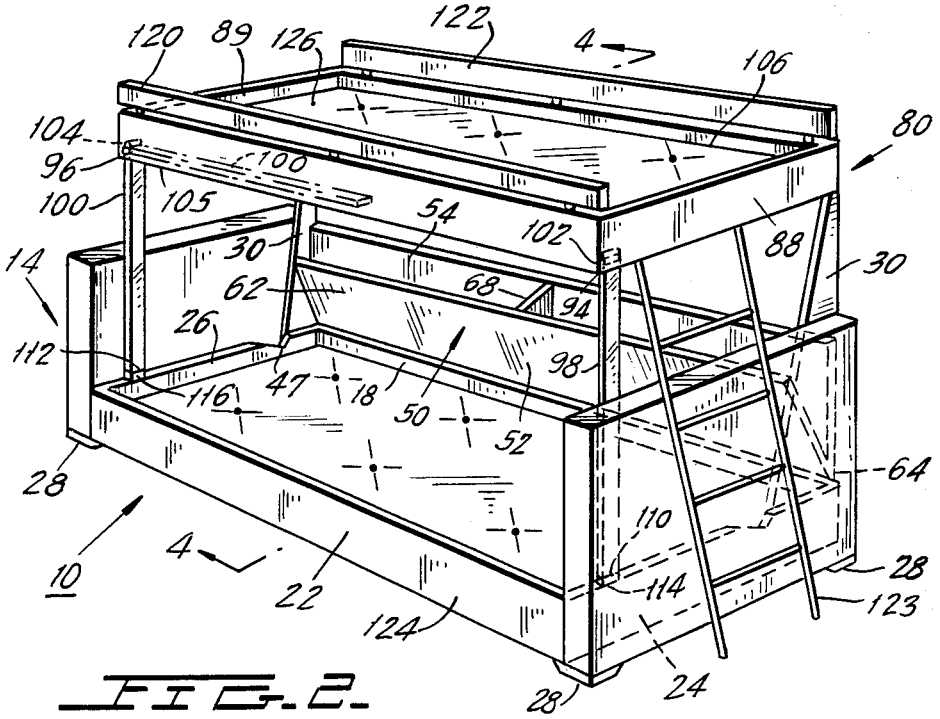
FIG. 2

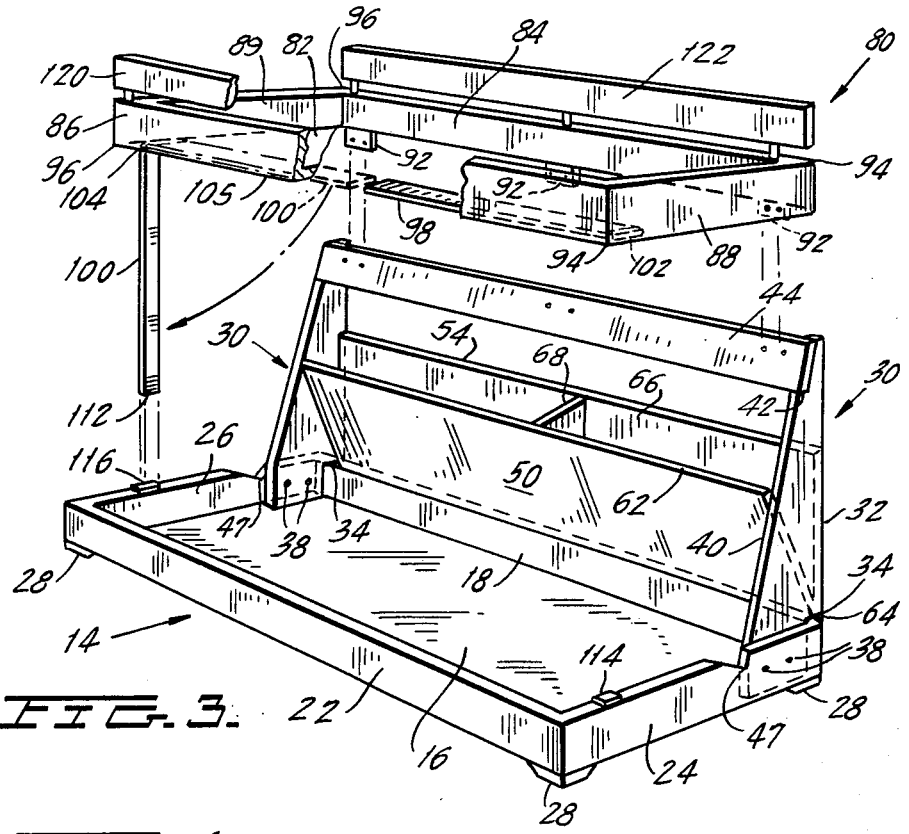
FIG. 3.
FIG. 4.
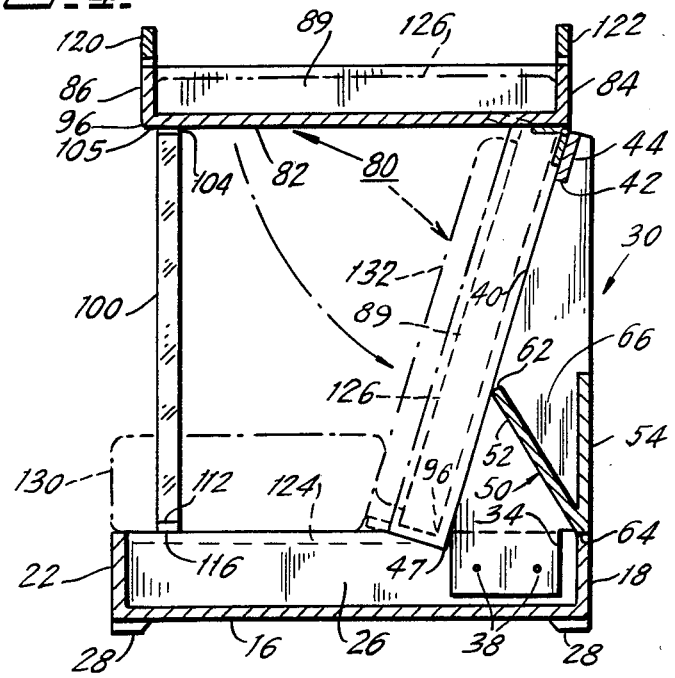

SOFA-BUNK BED COMBINATION

BACKGROUND OF THE INVENTION

The present invention relates to a combination sofa and bunk bed wherein the sofa seat can be converted into the bottom bunk of a bunk bed and the sofa back can be pivoted to an upraised horizontal orientation where it will serve as the upper bunk of a bunk bed.

Various combination sofa-bunk beds are known. Most include fairly complex structures and linkages for controlling the movement of the unit that defines either the sofa back or the upper bunk. Also, the support for the upraised upper bunk is relatively complex. Additionally, these combinations often must occupy considerably more floor space when in their bunk bed mode than when in their sofa mode. Further, self-contained storage for objects which might be needed when the bed is opened, as with pillows, is typically not provided. In addition, assembly and disassembly of the sofa-bunk bed combinations is rather complex. Finally, possible separation of the combination into separate upper and lower bunks is not contemplated.

Examples of known sofa-bunk bed combinations having the foregoing problems are now noted.

Griffin, U.S. Pat. No. 3,310,815, shows a complex linkage for guiding the upper bunk in its movements. Also, the lower bunk is moved as the sofa moves to the bunk bed mode, increasing the floor space occupied by the combination. Similar comments apply to Griffin, U.S. Pat. No. 3,191,194; Coomes, U.S. Pat. No. 3,858,254; Riches, U.S. Pat. No. 3,736,601; Mills, U.S. Pat. No. 2,835,901; Nyman, U.S. Pat. No. 3,070,813 and Bryks, U.S. Pat. No. 3,594,832; Hagstrom, U.S. Pat. No. 2,854,672. Note also Read, U.S. Pat. No. 2,644,169.

Klingler, U.S. Pat. No. 4,044,410 shows a seat back which must be unfolded itself before it can serve as an upper bunk. This extra folding operation and the complex structure it requires is preferably to be avoided.

Furthermore, none of these has self-contained storage for objects, which is hidden when the sofa-bunk bed combination is in the sofa mode.

BRIEF DESCRIPTION OF THE INVENTION

It is the primary object of the invention to provide a sofa-bunk bed combination which is easily converted between the sofa and the bunk bed modes.

A further object of the invention is to also be able to convert the combination to a single bed mode.

It is another object of the invention to readily provide support for the upper bunk once the back of the sofa has been raised to define the upper bunk.

It is another object of the invention to provide for storage of objects which are accessible in the bunk bed modes and single bed and to hide the storage area in the sofa mode.

It is yet another object of the invention to provide such a combination which requires no additional floor space as a bunk bed than as a sofa.

It is a further object of the invention to facilitate the knock-down assembly and disassembly of the sofa-bunk bed, if required.

Yet another object of the invention is to facilitate use of the combination as two separate beds.

It is yet another object of the invention to simplify the construction of the combination.

According to the invention, the sofa-bunk bed combination is comprised of a small number of components.

There is a bottom support on which the bottom bunk mattress is disposed and on which the sofa seat cushions are removably disposed. At the sides of and toward the rear of the bottom support are side upright elements. These upright elements support the sofa back along with the bottom support when the combination is in the sofa mode. The upright elements support the rear edge of the upper bunk when the combination is in the bunk bed mode. A back board extends across the space between the upright elements, forming together with the upright elements and the bottom support a sufficiently strong and rigid rear support for the upper bunk.

An important feature of the invention is a storage unit, shaped as a bin open at its top, for example, which is supported to the upright elements at the rear of the bottom support. The storage bins may receive bed pillows or any other objects. The storage bin preferably does not extend rearwardly of the rear edges of the upright elements or of the bottom support. It projects slightly forwardly from the rear edges, to give the bin its front to back width.

When the combination is in the sofa mode, the sofa back is suspended from the top of the back board and is inclined forwardly down into a notch formed in the bottom support, creating a generally triangularly shaped open space between the under-rear surface of the upper bunk-sofa back and the rear side of the bottom support and the front side of the upright elements. The storage unit is preferably shaped to fit within that triangular open space, which the inclined sofa back permits.

The sofa back-upper bunk unit comprises another support, which is hingedly attached to the top of the back board that extends between the upright side elements, and the sofa back-upper bunk pivots between its two modes around the hinge connection. As noted above, when it is pivoted into its sofa mode, the upper bunk-sofa back is not vertical, but is instead inclined slightly forwardly for leaving space beneath and behind the sofa back for the storage unit. The upper bunk-sofa back rests in notches at the sides of the bottom support.

At the two front corners of the underside of the upper bunk are disposed respective hingedly connected legs, which are foldable between a downwardly depending orientation where they rest upon the bottom support or they are folded up under the bottom of the upper bunk-sofa back, so as to not interfere with the lowering of the sofa back into the sofa mode.

Additional features which finish the sofa-bunk bed combination include upwardly projecting safety boards at the front and/or the rear edges of the upper bunk, so as to prevent a person on the upper bunk from falling out.

The support of the bottom bunk and sofa bottom and the support of the upper bunk and sofa rear are both framed rectangles with the framing provided by upstanding peripheral frame panels, whereby both the bottom bunk and the upper bunk are open top, short height boxes. This strengthens and rigidifies both the bottom and the upper bunks. This additionally helps hold the mattresses of both the top and bottom bunks in place, especially as the upper bunk is pivoted into and out of the sofa and upper bunk modes. Also, the frame panels of the upper bunk hold the sofa back cushions in place over the upper bunk mattress when the sofa back is tilted up with the cushions in place, so that the combination can also serve as a single bed. The above-described safety boards at the upper bunk would be above the top edges of the peripheral frame panels.

The upper bunk should be light in weight. A spring for the mattress of the upper bunk may be suspended from the frame panels. Or, the mattress may be supported on a light weight plywood panel held by metal straps on to the frame. Appropriately styled sofa sides are affixed to and stand up from the bottom platform, to provide arm rests for the sofa. The sofa sides also serve as a ladder to the upper bunk.

The foregoing arrangement permits the mattresses of both the upper and bottom bunks to remain in while the combination is in both the sofa and bunk bed modes. Any bedding, except thick pillows, can also remain in place. The seat cushions which cover the sofa seat and the sofa back will also cover and protect the mattresses and bedding.

The simplicity of the foregoing combination permits its easy and rapid assembly and disassembly. The elements need to be connected together at a minimal number of spots sufficient to hold the combination together, without complex linkages and brackets. In addition, the upper and lower bunks can be separated and with the support legs folded up, the upper bunk can serve as a separate bed. Finally, with all of its features, the combination always retains the same dimensions in each of its modes and while it is being converted between modes.

The foregoing and other objects and features of the invention will become apparent from the following description of a preferred embodiment of the invention, considered in conjunction with the accompanying drawings.

BRIEF DESCRIPTION OF THE DRAWINGS

FIG. 1 is a perspective view of the bunk bed-sofa combination of the invention in the sofa mode;

FIG. 2 is a perspective view thereof in the bunk bed mode;

FIG. 3 is a perspective, exploded view of the combination without mattresses and cushions; and FIG. 4 is cross-sectional view at the lines 4 in FIG. 2.

DESCRIPTION OF A PREFERRED EMBODIMENT

The sofa-bunk bed combination 10 according to the present invention has the sofa mode shown in FIG. 1 and the bunk bed mode shown in FIG. 2. The structure of the present invention permits rapid conversion of the combination between its illustrated modes.

Referring next to FIG. 3, the combination includes the bottom unit 14, including a horizontal, flat bottom support or platform 16 which is rectangular in shape and has the dimensions of a bed mattress. The platform 16 is surrounded by the short height, upstanding, side frame panels, including the front and rear side panels 18, 22 and the left and right side panels 24, 26. These panels define with the platform 16 a fairly rigid supporting framework. Short height feet 28 beneath the corners of the platform 16 raise it above the floor so that the sofa seat cushions will be at the expected sofa height.

At the end of each side panel 24, 26 toward the rear panel 18 and inside each side panel, a respective side upright element 30 is fixedly attached. The back edge 32 of each upright element is flat. The notch 34 at the bottom of the side upright element 30 receives the rear panel 18 therein and the upper wall of the notch 34 rests on the top of the panel 18. The back edge 32 of the upright element continues above the back surface of the panel 18 and this defines the rear side of the sofa-bunk bed combination. The front edge 40 of the upright element 30 is not vertical, but instead inclines rearwardly moving upwardly of the upright element. The front edge 40 defines a surface on which the underside-rear side of the below-described upper bunk-sofa back may rest and defines the resulting tilt angle of the sofa back. A notch 42 is formed at the top of the front edge 40 of the upright 30 for receiving a supporting back board 44.

The back board 44 is a rigid supporting panel, generally of the same materials and strength as the bottom support panels 16–24, and the board 44 extends between the notches 42 of the two side upright elements 30. The back board 44 rests on the bottom wall of the notches 42 and it is secured there by bolts, and/or adhesive, etc. The resulting bottom unit of the sofa and bed combination is quite sturdy. Separated from the below described upper bunk and sofa back, the bottom unit serves as a bed.

Immediately foward of the upright side elements 30, the side panels 24 and 26 have respective notches 47 which receive the front bottom edge of the upper unit 80 in the sofa mode as shown in FIG. 4.

A storage unit 50 is provided at the rear of the bottom unit 14 of the combination. The storage unit 50 includes a front wall 52, which faces forwardly of the sofa and the bottom bunk, and a rear wall 54. The front and rear walls of the unit 50 are respectively secured to the inner, inwardly facing surfaces of the side upright elements 30, which support the storage unit 50. The rear wall 54 of the storage unit is vertical and would be parallel to the rear edges 32 of the upright elements 30, whereby the storage unit 50 does not project rearwardly of the edge 32 and the vertical edge 32 defines the rear edge of the sofa-bunk bed combination. The front wall 52 of the storage unit is inclined, being tilted rearwardly of the bottom bunk from its top end 62 toward its bottom end 64. Its top end 62 is sufficiently forward to provide access into the interior of the bin space 66 created inside the storage unit by the walls 52 and 54. The top end 62 does not extend further forward than the rear surface of the sofa back when the sofa back is downward in the sofa mode, shown in FIGS. 2 and 4. The top edge 62 of the storage unit 50 extends up only part way along the height of the upright elements 30, so that the bin 66 can be open in the triangular space defined between the rear edges 32 of the upright elements 30 and the rear side of the sofa back. The bottom end 64 of the storage unit 50 terminates above the bottom of the rear panel 18 and the storage unit walls 52, 54 meet at the rear edge 32 of the upright 30, so as to not interfere with a mattress disposed on the platform 16. In addition, there may be an intermediate rigidifying wall 68. For convenience in shipment and assembly, storage unit 50 and the upright side elements 30 can be a separate subassembly and that subassembly can be conveniently attached to the bottom unit 14 at the side panels 24, 26 upon assembly of the combination.

With reference to FIGS. 1 and 2, decorative sofa arms 70 are supported on their uprights 72, which are, in turn, attached to the exterior sides of the bottom side panels 24, 26. The appearance and design of the side arms 70 for the sofa are a matter of choice. For instance, the arms 70 could be provided with storage compartments, in addition to the storage unit 50. The arms may also serve as a ladder to the upper bunk.

The top unit of the combination comprises the top bunk-sofa back 80. That includes a flat, stiff, thin, light weight, plywood platform 82, which is surrounded by four side panels, including the rear panel 84, the opposite front panel 86 and the left and right side panels 88 and 89. The platform 82 is suspended on straps from the panels. The four side panels are secured together and project above the platform 82 for defining a mattress containing lip, which positions the mattress on the platform 82 even as the top bunk-sofa back moves between its sofa and bunk bed modes. In a modification, not shown, a bed spring is suspended from the panels 84, 86, 88 and 89 and the mattress sits on this spring. The panels also support the below described seat back cushions, if it is decided to leave them in place over the mattress as the sofa back is pivoted.

Attached at the underside of the rear panel 84 are a plurality of hinges 92 which are detachably connected by bolts, or the like, to the rear side of the back board 44 of the bottom unit of the sofa-bunk bed. When the combination is in the sofa mode, the bottom-forward corners 94 and 96 of the end panels 88, 89 rest in the notches 47 in the panels 24 and 26, which defines the inclination of the back of the sofa.

At the two front corners 94, 96 of the top unit 80, respective folding legs 98, 100 are disposed. They are hingedly connected at 102, 104, respectively, to the underside 105 of the front panel 86. In FIGS. 2–4, they are illustrated in their unfolded, upright condition, at which they support the upper bunk 80 in its upraised condition above the lower bunk. In FIG. 3, in contrast, both of the legs are shown folded up in phantom against the underside of the panel 86 and out of the way, and when both legs are folded up, the upper bunk may be lowered to its position as a sofa back. The particular direction in which the legs 98, 100 are folded up is a matter of choice, and they may be folded obliquely across and rearwardly of the underside of the top platform 82, so long as they do not interfere with the folding down of the upper bunk to define the sofa back. The folding leg linkage may hold the legs up. Alternatively, fastening means may be provided. One particularly effective means is a hook and loop type fastener such as the one sold under the trademark Velcro fastening between the legs and the underside of the upper bunk. When unfolded, the bottom ends 110, 112 of the folding legs 98, 100, respectively, are seated on the seats or receptacles 114, 116, respectively, atop the corresponding front corners of the panels of the bottom bunk. The seats 114, 116 will hold the legs sufficiently securely against undesired folding and against slipping off, which would permit the upper bunk to fall. Appropriate securement techniques, such as short length collars for receiving the leg bottom ends 110, 112, and appropriate locking mechanism, as is used with folding table legs, or the like, would prevent the folding legs 98, 100 from undesirably folding, until the locking mechanism is released. If desired, an appropriate hydraulic lift mechanism (not shown) may be associated with the legs to aid in lifting the upper bunk.

At the front panel 86 and/or at the rear panel 84, an additional short height upstanding safety board 120 and/or 122 is supported above the upper edge of the panel. This is especially useful at the front side of the upper bunk which also is the bottom of the sofa back. The safety boards protect the occupant of the upper bunk against falling. The safety boards are supported on respective posts which are received in cooperating holes in the panels 84 and 86, from which they can be lifted to remove the safety boards. In FIG. 1, the rear safety board 122 has been removed. As shown in FIG. 2, the safety boards are shaped to enable their being grasped. This would permit the sofa back to be adjusted by manipulating the guard rails.

While it is primarily contemplated that the bottom and top units be normally secured together as a sofa and bed combination, by simply detaching the hinges 92 from the back board 44, the top unit 80 is separate from the bottom unit 14, and the folded up legs 98, 100 permit the top unit to be seated on the floor as a completely separate bed.

To provide access to the upper bunk, an additional ladder 123 is supported at the underside of the upper bunk, which is the rear of the sofa back. The ladder may be hingedly connected to the edge of a side panel, to be folded up when out of use, or the ladder may be received in a channel provided for it. Also, the ladder could be stored in the storage unit 50. If the ladder 123 is hinged to the upper bunk, it should be placed rearwardly enough along the side of the upper bunk so as to not interfere with the storage unit 50, which is adjacent to the bottom half of the folded down sofa back, which corresponds to the front half of the upper bunk.

By the foregoing simple mechanism, the framework of a convertible combination sofa-bunk bed is defined which is relatively easy to operate, which is safe, which is easy to assemble or knock down and disassemble, which can also be separated into two beds, and which includes a convenient storage bin within the peripheral confines of the sofa-bed construction and wherein the sofa back has a convenient incline.

The lower platform 16 supports upon it a mattress 124 which is held inside the space surrounded by the lower unit side panels 18–26. Similarly, an upper mattress 126 is seated atop the upper platform 82 or a spring at the location and the mattress is held inside the space surrounded by the upper unit side panels 84–89. The side panels 84–89 hold the upper mattress 126 in the correct position in both the sofa and bunk bed modes and during movement between those modes. With bedding on the mattresses, if the user wishes, and when the combination is in the sofa mode, seat bottom cushions 130 may be simply seated atop the bottom mattress 124 and any bedding thereon and seat back cushions 132 may be disposed over the inclined upper mattress 126. The upper unit side panels 84–89 are of a height that the upper mattress and the seat back cushions also would be supported between the front and rear safety boards 120, 122, which would prevent the cushions 132 from falling out of place. If it is desired to use the combination as only a single bottom bunk bed, the sofa back is raised up with the cushions held in place by the panels 84–89, and this opens the bottom bunk as a bed.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A sofa-bunk bed combination comprising:

a bottom unit, comprising a bottom support for defining a bottom bunk-sofa seat; the bottom support having a front side, a rear side and two lateral sides between the front and rear sides;

upright elements at the lateral sides of the bottom support toward the rear side thereof;

an upper unit comprising an upper support for serving as an upper bunk when the combination is in the bunk bed mode and for serving as a sofa seat back when the combination is in the sofa mode; the upper support also having a respective rear side, an opposite front side, and two lateral sides between the front and rear sides; a hinge connection extending from the upper support and to the upright side elements of the bottom unit for enabling pivoting of the upper unit between the bunk bed mode, wherein the upper support is upraised horizontally, and the sofa mode, wherein the upper support is suspended down, such that the front side of the upper support is down toward the lower support;

the upper support being non-foldable, whereby it maintains the same dimensions when it is in the bunk bed mode and when it is extending downward in the sofa mode; during pivoting of the upper support between the upraised bunk bed mode and the downwardly inclined orientation in the sofa mode, the bottom support remaining stationary and nonshifting;

legs attached to the upper support and extending down from the upper support toward the bottom support; means on the bottom support for receiving and holding the ends of the legs extending down from the upper support toward the bottom support;

a storage unit for storage therein of objects, the storage unit being supported to the upright side elements and having a front side including a front wall extending across the storage unit front side, closing off that front side, and projecting forwardly toward the front side of the bottom support; the shape of the storage unit front wall being correlated to the orientation of the downwardly inclined upper support, such that when the upper support is in the sofa mode, the front wall of the storage unit does not interfere with the upper support moving into the sofa mode.

2. The combination of claim 1, wherein the storage unit includes a rear wall, and the rear wall thereof is parallel to the rear sides of the upright elements, whereby the storage unit does not project rearward of the rear side of the combination.

3. The combination of claim 1, wherein the storage unit front wall comprises an inclined front wall which has a top edge above the lower support and a bottom edge toward the lower support, the top edge of the front wall being more forward with respect to the front of the lower support than the bottom edge of the front wall, whereby the front wall of the storage unit is inclined toward the rear of the lower support moving down along the front wall.

4. The combination of claim 3, wherein the storage unit is of a height less than the height of the upright elements.

5. The combination of claim 3, wherein the storage unit includes a rear wall, and the rear wall thereof is parallel to the rear sides of the upright elements, whereby the storage unit does not project rearward of the rear side of the combination.

6. The combination of claim 5, wherein the storage unit has a top end thereof which is open for permitting access thereinto.

7. The combination of claim 6, wherein the storage unit is of a height less than the height of the upright elements.

8. A sofa-bunk bed combination comprising:

a bottom unit, comprising a bottom support for defining a bottom bunk-bed sofa seat; the bottom support having a front side, a rear side and two lateral sides between the front and rear sides;

upright elements at the lateral sides of the bottom support toward the rear side thereof;

an upper unit comprising an upper support for serving as an upper bunk when the combination is in the bunk bed mode and for serving as a sofa seat back when the combination is in the sofa mode; the upper support also having a respective rear side, an opposite front side, and two lateral sides between the front and rear sides; a hinge connection extending from the upper support and to the upright side elements of the bottom unit for enabling pivoting of the upper unit raised horizontally, and the sofa mode, wherein the upper support is suspended down, such that the front side of the upper support is down toward the lower support;

the upper support being non-foldable, whereby it maintains the same dimensions when it is in the bunk bed mode when it is extending downward in the sofa mode; during pivoting of the upper support between the upraised bunk bed mode and the downwardly inclined orientation in the sofa mode, the bottom support remaining stationary and nonshifting;

legs attached to the upper support and extending from the upper support toward the bottom support; means on the bottom support for receiving and holding the ends of the legs extending down from the upper support toward the bottom support;

the lower support including a respective first plurality of short-height, upstanding side panels which surround the bottom support and define the sides thereof;

the upper support including a respective second plurality of short-height upstanding side panels which surround the upper support and also define the sides thereof; and at generally each lateral side of the bottom unit there being attached a respective side upright element upstanding from the bottom unit, and each upright element having a front edge facing toward the front of the lower support; the front edges being inclined from the vertical, inclined rearwardly moving upwardly of the upright elements, and;

the side panels at the lateral sides of the bottom support having top sides with notches defined therein for receiving and being generally shaped to the front part of the upper support.

9. A sofa-bed combination comprising:

a bottom unit, comprising a bottom support for defining a bed-sofa seat; the bottom support having a front side, a rear side and two lateral sides between the front and rear sides;

upright elements at the lateral sides of the bottom support toward the rear side thereof;

an upper support for serving as a sofa seat back when the combination is in the sofa mode; the upper support also having a respective rear side, an opposite front side, and two lateral sides between the front and rear sides; a hinge connection extending from the upper support and to the upright side elements of the bottom unit for enabling pivoting of the upper unit between the bunk bed mode, wherein the upper unit is upraised horizontally off the bottom unit, and the sofa mode, wherein the upper support is suspended down, such that the front side of the support is down toward the lower support;

the upper support being non-foldable, whereby it maintains the same dimensions when it is upraised and when it is extending downward in the sofa mode; during pivoting of the upper support between the upraised condition and the downwardly inclined orientation in the sofa mode, the bottom support remaining stationary and non-shifting;

legs attached to the upper support and extending down from the upper support toward the bottom support; means on the bottom support for receiving and holding the ends of the legs extending down from the upper support toward the bottom support;

a storage unit for storage therein of objects, the storage unit being supported to the upright side elements and having a front side including a front wall extending across the storage unit front side, closing off that front side, and projecting forwardly toward the front side of the bottom support; the shape of the storage unit front wall being correlated to the orientation of the downwardly inclined upper support, such that when the upper support is in the sofa mode, the front wall of the storage unit does not interfere with the upper support moving into the sofa mode.

10. The combination of claim 9, wherein the storage unit front side comprises an inclined front wall which has a top edge above the lower support and a bottom edge toward the lower support, the top edge of the front wall being more forward with respect to the front wall, whereby the front wall of the storage unit is inclined toward the rear of the lower support moving down along the front wall.

11. A sofa-bed combination comprising:

a bottom unit, comprising a bottom support for defining a bed-sofa seat; the bottom support having a front side, a rear side and two lateral sides between the front and rear sides;

upright elements at the lateral sides of the bottom support toward the rear side thereof;

an upper support for serving as a sofa seat back when the combination is in the sofa mode; the upper support also having a respective rear side, an opposite front side, and two lateral sides between the front and rear sides; a hinge connection extending from the upper support and to the upright side elements of the bottom unit for enabling pivoting of the upper unit between a mode, wherein the upper support is upraised horizontally off the bottom unit, and the sofa mode, wherein the upper support is suspended down, such that the front side of the upper support is down toward the lower support;

the upper support being non-foldable, whereby it maintains the same dimensions when it is upraised and when it is extending downward in the sofa mode; during pivoting of the upper support between the upraised condition and the downwardly inclined orientation in the sofa mode, the bottom support remaining stationary and non-shifting;

legs attached to the upper support and extending down from the upper support toward the bottom support for receiving and holding the ends of the legs extending down from the upper support toward the bottom support;

the lower support including a respective first plurality of short-height, upstanding side panels which surround the bottom support including a respective second plurality of short-height upstanding side panels which surround the upper support and also define the sides thereof;

at generally each lateral side of the bottom unit there being attached a respective side upright element upstanding from the bottom unit, and each upright element having a front edge facing toward the front of the lower support; the front edges being inclined from the vertical, inclined rearwardly moving upwardly of the upright elements, and;

the side panels at the lateral sides of the bottom support having top sides with notches defined therein for receiving and being generally shaped to the front side of the upper support.

* * * * *